US010165381B2

(12) United States Patent
Baek et al.

(10) Patent No.: US 10,165,381 B2
(45) Date of Patent: Dec. 25, 2018

(54) AUDIO SIGNAL PROCESSING METHOD AND DEVICE

(71) Applicant: GAUDI AUDIO LAB, INC., Seoul (KR)

(72) Inventors: Yonghyun Baek, Seoul (KR); Jeonghun Seo, Seoul (KR); Sewoon Jeon, Daejeon (KR); Sangbae Chon, Seoul (KR)

(73) Assignee: GAUDI AUDIO LAB, INC., Seoul (KR)

( * ) Notice: Subject to any disclaimer, the term of this patent is extended or adjusted under 35 U.S.C. 154(b) by 0 days.

(21) Appl. No.: 15/961,893

(22) Filed: Apr. 25, 2018

(65) Prior Publication Data

US 2018/0242094 A1 Aug. 23, 2018

Related U.S. Application Data

(63) Continuation of application No. PCT/KR2018/001833, filed on Feb. 12, 2018.

(30) Foreign Application Priority Data

Feb. 10, 2017 (KR) ..... 10-2017-0018515

(51) Int. Cl.
*H04R 5/04* (2006.01)
*H04S 1/00* (2006.01)

(52) U.S. Cl.
CPC ..... *H04S 1/007* (2013.01); *H04R 5/04* (2013.01)

(58) Field of Classification Search
CPC ... H04S 1/00; H04S 3/02; H04S 1/002; H04S 2420/01; H04R 5/04
(Continued)

(56) References Cited

U.S. PATENT DOCUMENTS

2014/0355795 A1* 12/2014 Xiang ..... H04S 7/305 381/303
2016/0088417 A1* 3/2016 Kim ..... G02B 27/017 381/17
2016/0373877 A1 12/2016 Laitinen

FOREIGN PATENT DOCUMENTS

KR 10-2011-0082553 A 7/2011
KR 10-2016-0015265 A 2/2016
(Continued)

OTHER PUBLICATIONS

International Search Report and Written Opinion of the International Searching Authority dated Jun. 11, 2018 for Application No. PCT/KR2018/001833 with English translation.

*Primary Examiner* — Melur Ramakrishnaiah
(74) *Attorney, Agent, or Firm* — Park, Kim & Suh, LLC

(57) ABSTRACT

Disclosed is an audio signal processing device for rendering an input audio signal. The audio signal processing device includes a receiving unit configured to receive the input audio signal, a processor configured to generate an output audio signal by binaural rendering the input audio signal, and an output unit configured to output the output audio signal generated by the processor. The processor obtains a first transfer function based on a position of a virtual sound source corresponding to the input audio signal with respect to a listener, generates at least one flat response having a constant magnitude in a frequency domain, generates a second transfer function based on the first transfer function and the at least one flat response, and generates the output audio signal by binaural rendering the input audio signal based on the generated second transfer function.

20 Claims, 7 Drawing Sheets

(58) Field of Classification Search
USPC ..... 381/309, 300, 17
See application file for complete search history.

(56) References Cited

FOREIGN PATENT DOCUMENTS

| | | | |
|---|---|---|---|
| KR | 10-2016-0094349 | A | 8/2016 |
| KR | 10-2016-0136716 | A | 11/2016 |

* cited by examiner

VPC(501)

IPC(502)

AUDIO SIGNAL PROCESSING METHOD AND DEVICE

CROSS-REFERENCE TO RELATED APPLICATIONS

This application claims the benefit under 35 U.S.C. § 120 and § 365(c) to a prior PCT International Application No. PCT/KR2018/001833, filed on Feb. 12, 2018, which claims the benefit of Korean Patent Application No. 10-2017-0018515, filed on Feb. 10, 2017, the entire contents of which are incorporated herein by reference.

TECHNICAL FIELD

The present disclosure relates to an audio signal processing method and device, and more particularly, to an audio signal processing method and device for binaural rending an input audio signal to provide an output audio signal.

BACKGROUND ART

A binaural rendering technology is essentially required to provide immersive and interactive audio in a head mounted display (HMD) device. Binaural rendering represents modeling a 3D audio, which provides a sound that gives a sense of presence in a three-dimensional space, into a signal to be delivered to the ears of a human being. A listener may experience a sense of three-dimensionality from a binaural rendered 2-channel audio output signal through a headphone, an earphone, or the like. A specific principle of the binaural rendering is described as follows. A human being listens to a sound through both ears, and recognizes the position and the direction of a sound source from the sound. Therefore, if a 3D audio can be modeled into audio signals to be delivered to both ears of a human being, the three-dimensionality of 2D audio can be reproduced through a 2-channel audio output without a large number of speakers.

Here, when the number of channels or objects included in an audio signal to be binaural rendered increases, the amount of calculation and power consumption required for binaural rendering may be increased. Therefore, a technology for efficiently performing binaural rendering on an input audio signal is required in a mobile device limited in calculation amount and power consumption.

Furthermore, when an audio signal processing device binaural renders an input audio signal using a binaural transfer function such as a head related transfer function (HRTF), a change of timbre due to characteristics of the binaural transfer function may cause degradation of sound quality of high-quality content such as music. When the timbre of content, from which high sound quality is required, changes significantly, a virtual reality effect provided to a listener may deteriorate. Therefore, a binaural rendering-related technology, which considers a timbre preservation and a sound localization of an input audio signal is required.

DISCLOSURE OF THE INVENTION

Technical Problem

An object of an embodiment of the present disclosure is to provide an audio signal processing device and method for generating an output audio signal according to required sound localization performance and timbre preservation performance by binaural rendering an input audio signal.

Technical Solution

An audio signal processing device for rendering an input audio signal according to an embodiment of the present invention includes a receiving unit configured to receive the input audio signal, a processor configured to generate an output audio signal by binaural rendering the input audio signal, and an output unit configured to output the output audio signal generated by the processor. The processor may be configured to obtain a first transfer function based on a position of a virtual sound source corresponding to the input audio signal with respect to a listener, generate at least one flat response having a constant magnitude in a frequency domain, generate a second transfer function based on the first transfer function and the at least one flat response, and generate the output audio signal by binaural rendering the input audio signal based on the generated second transfer function.

The processor may be configured to generate the second transfer function by calculating a weighted sum of the first transfer function and the at least one flat response.

The processor may be configured to determine a weight parameter which is used for the weighted sum of the first transfer function and the at least one flat response, based on binaural effect strength information corresponding to the input audio signal, and may generate the second transfer function based on the determined weight parameter.

The processor may be configured to generate the second transfer function by calculating, for each frequency bin, a weighted sum of magnitude components and the at least one flat response based on the weight parameter. Here, phase components of the second transfer function may be identical to phase components of the first transfer function corresponding to the respective frequency bins in the frequency domain.

The processor may be configured to determine a panning gain based on the position of the virtual sound source corresponding to the input audio signal with respect to the listener. Furthermore, the processor may be configured to generate the at least one flat response based on the panning gain.

The processor may be configured to determine the panning gain based on an azimuth value of an interaural polar coordinates indicating the position of the virtual sound source.

The processor may be configured to convert the vertical polar coordinates indicating the position of the virtual sound source into the interaural polar coordinates, and may determine the panning gain based on an azimuth value of the converted interaural polar coordinates.

The processor may be configured to generate the at least one flat response based on at least a part of the first transfer function. Here, the at least one flat response may be a mean of magnitude components of the first transfer function corresponding to at least some frequencies.

The first transfer function may be either an ipsilateral head related transfer function (HRTF) or a contralateral HRTF included in an HRTF pair corresponding to the position of the virtual sound source corresponding to the input audio signal.

The processor may be configured to generate each of an ipsilateral second transfer function and a contralateral second transfer function based on each of the ipsilateral HRTF and the contralateral HRTF, and the at least one flat response, and set a sum of energy levels of the ipsilateral second transfer function and the contralateral second transfer function to be equal to a sum of energy levels of the ipsilateral HRTF and the contralateral HRTF.

The audio signal processing device according to an embodiment of the present invention may generate the output audio signal based on the first transfer function and the at least one flat response. The processor may be configured to generate a first intermediate signal by filtering the input audio signal based on the first transfer function. Here, the generating of the first intermediate signal by filtering the input audio signal may include generating the first intermediate signal by binaural rendering the input audio signal. Furthermore, the processor may be configured to generate a second intermediate signal by filtering the input audio signal based on the at least one flat response.

The processor may be configured to generate the output audio signal by mixing the first intermediate signal and the second intermediate signal. The processor may be configured to determine a mixing gain which is used to mix the first intermediate signal and the second intermediate signal. Here, the mixing gain may indicate a ratio between the first intermediate signal and the second intermediate signal reflected in the output audio signal.

The processor may be configured to determine, based on binaural effect strength information corresponding to the input signal, a first mixing gain which is applied to the first transfer function and a second mixing gain which is applied to the at least one flat response. The processor may be configured to generate the output audio signal by mixing the first transfer function and the at least one flat response based on the first mixing gain and the second mixing gain.

An audio signal processing method according to an embodiment of the present invention includes the steps of: receiving an input audio signal, obtaining a first transfer function based on a position of a virtual sound source corresponding to the input audio signal with respect to a listener, generating at least one flat response having a constant magnitude in a frequency domain, generating a second transfer function based on the first transfer function and the at least one flat response, generating an output audio signal by binaural rendering the input audio signal based on the generated second transfer function and outputting the generated output audio signal.

Advantageous Effects

An audio signal processing device and method according to an embodiment of the present disclosure may use a flat response to reduce a timbre distortion that occurs during a binaural rendering process. Furthermore, the audio signal processing device and method may have an effect of preserving the timbre while maintaining a characteristic that gives an elevation perception, by adjusting the degree of sound localization.

MODE FOR CARRYING OUT THE INVENTION

Figure 1:
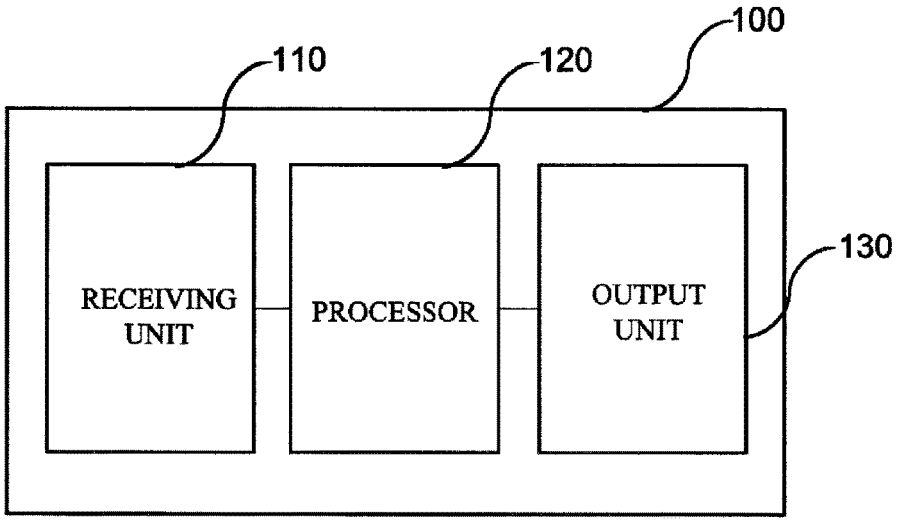
FIG. 1 is a block diagram illustrating a configuration of an audio signal processing device according to an embodiment of the present disclosure.

Hereinafter, embodiments of the present invention will be described in detail with reference to the accompanying drawings so that the embodiments of the present invention can be easily carried out by those skilled in the art. However, the present invention may be implemented in many different forms and is not limited to the embodiments described herein. Some parts of the embodiments, which are not related to the description, are not illustrated in the drawings to clearly describe the embodiments of the present disclosure. Like reference numerals refer to like elements throughout the description.

When it is mentioned that a certain part "includes" or "comprises" certain elements, the part may further include other elements, unless otherwise specified. When it is mentioned that a certain part "includes" or "comprises" certain elements, the part may further include other elements, unless otherwise specified.

The present application claims priority based on Korean Patent Application No. 10-2017-0018515 (Feb. 10, 2017), the embodiments and descriptions of which are deemed to be incorporated herein.

The present disclosure relates to a method by which an audio signal processing device generates an output audio signal by binaural rendering an input audio signal. According to an embodiment of the present disclosure, an audio signal processing device may generate an output audio signal based on a flat response and a binaural transfer function pair corresponding to an input audio signal. The audio signal processing device according to an embodiment of the present disclosure may use the flat response to reduce a timbre distortion that occurs during a binaural rendering process. Furthermore, the audio signal processing device according to an embodiment of the present disclosure may use the flat response and a weight parameter to provide, to a listener, various sounds environments according to binaural rendering effect strength control.

Hereinafter, the present invention will be described in detail with reference to the accompanying drawings.

FIG. 1 is a block diagram illustrating a configuration of an audio signal processing device 100 according to an embodiment of the present disclosure.

According to an embodiment, the audio signal processing device 100 may include a receiving unit 110, a processor 120, and an output unit 130. However, not all of the elements illustrated in FIG. 1 are essential elements of the audio signal processing device. The audio signal processing device 100 may additionally include elements not illustrated in FIG. 1. Furthermore, at least some of the elements of the audio signal processing device 100 illustrated in FIG. 1 may be omitted.

The receiving unit 110 may receive an audio signal. The receiving unit 110 may receive an input audio signal input to the audio signal processing device 100. The receiving unit 110 may receive an input audio signal to be binaural rendered by the processor 120.

Here, the input audio signal may include at least one of an object signal or a channel signal. Here, the input audio signal may be one object signal or mono signal. Alternatively, the input audio signal may be a multi-object or multi-channel signal. According to an embodiment, when the audio signal processing device 100 includes a separate decoder, the audio signal processing device 100 may receive an encoded bitstream of the input audio signal.

According to an embodiment, the receiving unit 110 may be equipped with a receiving means for receiving the input audio signal. For example, the receiving unit 110 may include an audio signal input port for receiving the input audio signal transmitted by wire. Alternatively, the receiving unit 110 may include a wireless audio receiving module for receiving the audio signal transmitted wirelessly. In this case, the receiving unit 110 may receive the audio signal transmitted wirelessly by using a Bluetooth or Wi-Fi communication method.

The processor 120 may be provided with one or more processor to control the overall operation of the audio signal processing device 100. For example, the processor 120 may control operations of the receiving unit 110 and the output unit 130 by executing at least one program. Furthermore, the processor 120 may execute at least one program to perform the operations of the audio signal processing device 100 described below with reference to FIGS. 3 to 6.

For example, the processor 120 may generate an output audio signal. The processor 120 may generate the output audio signal by binaural rendering the input audio signal received through the receiving unit 110. The processor 120 may output the output audio signal through the output unit 130 that will be described later.

According to an embodiment, the output audio signal may be a binaural audio signal. For example, the output audio signal may be a 2-channel audio signal representing the input audio signal as a virtual sound source located in a three-dimensional space. The processor 120 may perform binaural rendering based on a transfer function pair that will be described later. The processor 120 may perform binaural rendering in a time domain or a frequency domain.

According to an embodiment, the processor 120 may generate a 2-channel output audio signal by binaural rendering the input audio signal. For example, the processor 120 may generate the 2-channel output audio signal corresponding to both ears of a listener, respectively. Here, the 2-channel output audio signal may be a binaural 2-channel output audio signal. The processor 120 may generate an audio headphone signal represented in three dimensions by binaural rendering the above-mentioned input audio signal.

According to an embodiment, the processor 120 may generate the output audio signal by binaural rendering the input audio signal based on a transfer function pair. The transfer function pair may include at least one transfer function. For example, the transfer function pair may include a pair of transfer functions corresponding to both ears of the listener. The transfer function pair may include an ipsilateral transfer function and a contralateral transfer function. In detail, the transfer function pair may include an ipsilateral head related transfer function (HRTF) corresponding to a channel for an ipsilateral ear and a contralateral HRFT corresponding to a channel for a contralateral ear.

Hereinafter, for convenience, the transfer function is used as a term representing any one among the one or more transfer functions included in the transfer function pair, unless otherwise specified. An embodiment described based on the transfer function may be applied to each of the one or more transfer functions in the same way. For example, when a first transfer function pair includes an ipsilateral first transfer function and a contralateral first transfer function, an embodiment may be described based on a first transfer function representing any one of the ipsilateral first transfer function and the contralateral first transfer function. An embodiment described based on the first transfer function may be applied in a same or corresponding manner to each of the ipsilateral and contralateral first transfer functions.

In the present disclosure, the transfer function may include a binaural transfer function used for binaural rending an input audio signal. The transfer function may include at least one of an HRTF, interaural transfer function (ITF), modified ITF (MITF), binaural room transfer function, (BRTF), room impulse response (RIR), binaural room impulse response (BRIR), head related impulse response (HRIR), or modified/edited data thereof, but the present disclosure is not limited thereto. For example, the binaural transfer function may include a secondary binaural transfer function obtained by linearly combining a plurality of binaural transfer functions.

The transfer function may be measured in an anechoic room, and may include information on an HRTF estimated by simulation. A simulation technique used for estimating the HRTF may be at least one of a spherical head model (SHM), a snowman model, a finite-difference time-domain method (FDTDM), or a boundary element method (BEM). Here, the spherical head model represents a simulation technique in which simulation is performed on the assumption that a human head is spherical. Furthermore, the snowman model represents a simulation technique in which simulation is performed on the assumption that a human head and body are spherical. The transfer function may be obtained by performing fast Fourier transform on an impulse response, but a transform method is not limited thereto.

According to an embodiment, the processor 120 may determine the transfer function pair based on a position of a virtual sound source corresponding to the input audio signal. Here, the processor 120 may obtain the transfer function pair from a device (not illustrated) other than the audio signal processing device 100. For example, the processor 120 may receive at least one transfer function from a database including a plurality of transfer functions. The database may be an external device for storing a transfer function set including a plurality of transfer functions. Here, the audio signal processing device 100 may include a separate communication unit (not illustrated) which requests a transfer function from the database, and receives information on the transfer function from the database. Alternatively, the processor 120 may obtain the transfer function pair corresponding to the input audio signal based on a transfer function set stored in the audio signal processing device 100.

According to an embodiment, the processor 120 may generate the output audio signal by binaural rendering the input audio signal based on the transfer function pair obtained using the above-mentioned method. For example, the processor 120 may generate a second transfer function based on the first transfer function obtained from the database and at least one flat response. Furthermore, the processor 120 may generate the output audio signal by binaural rendering the input audio signal based on the generated second transfer function. Relevant descriptions will be provided later in relation to a method for generating the output audio signal using the flat response. The flat response may be a filter response having a constant magnitude in a frequency domain.

According to an embodiment, post-processing may be additionally performed on the output audio signal of the processor 120. The post-processing may include crosstalk cancellation, dynamic range control (DRC), sound volume normalization, peak limitation, etc. Furthermore, the post-processing may include frequency/time domain conversion for the output audio signal of the processor 120. The audio signal processing device 100 may include a separate post-processing unit for performing the post-processing, and according to another embodiment, the post-processing unit may be included in the processor 120.

The output unit 130 may output the output audio signal. The output unit 130 may output the output audio signal generated by the processor 120. The output unit 130 may include at least one output channel. Here, the output audio signal may be a 2-channel output audio signal respectively corresponding to both ears of the listener. The output audio signal may be a binaural 2-channel output audio signal. The output unit 130 may output a 3D audio headphone signal generated by the processor 120.

According to an embodiment, the output unit 130 may be equipped with an output means for outputting the output audio signal. For example, the output unit 130 may include an output port for externally outputting the output audio signal. Here, the audio signal processing device 100 may output the output audio signal to an external device connected to the output port. Alternatively, the output unit 130 may include a wireless audio transmitting module for externally outputting the output audio signal. In this case, the output unit 130 may output the output audio signal to an external device by using a wireless communication method such as Bluetooth or Wi-Fi. Alternatively, the output unit 130 may include a speaker. Here, the audio signal processing device 100 may output the output audio signal through the speaker. Furthermore, the output unit 130 may additionally include a converter (e.g., digital-to-analog converter, DAC) for converting a digital audio signal to an analog audio signal.

According to an embodiment of the present disclosure, when the audio signal processing device 100 binaural renders the input audio signal using a binaural transfer function such as the above-mentioned HRTF, the timbre of the output audio signal may be distorted compared to the input audio signal. This is because magnitude components of the binaural transfer function are not constant in a frequency domain.

For example, the binaural transfer function may include a binaural cue for identifying the position of a virtual sound source with respect to a listener. In detail, the binaural cue may include an interaural level difference, an interaural phase difference, a spectral envelope, a notch component, and a peak component. Here, timbre preservation performance may be degraded due to the notch component and the peak component of the binaural transfer function. Here, the timbre preservation performance may indicate the degree of preservation of the timbre of the input audio signal in the output audio signal.

In particular, as the position of a virtual sound source corresponding to the input audio signal becomes farther away from a horizontal plane with respect to a listener (for example, as the elevation increases), a change of the timbre may increase. According to an embodiment of the present disclosure, the audio signal processing device 100 may use the flat response to reduce the timbre distortion that occurs during a binaural rendering process.

Hereinafter, a method of generating the output audio signal using the flat response by the audio signal processing device 100 according to an embodiment of the present disclosure is described.

According to an embodiment, the audio signal processing device 100 may generate the output audio signal by filtering the input audio signal based on the first transfer function pair and at least one flat response. Here, the audio signal processing device 100 may obtain the first transfer function pair based on the position of a virtual sound source corresponding to the input audio signal with respect to a listener. For example, the first transfer function pair may be a transfer function pair corresponding to a path from the virtual sound source corresponding to the input audio signal to the listener. In detail, the first transfer function pair may be a pair of HRTFs corresponding to the position of the virtual sound source corresponding to the input audio signal. The first transfer function pair may include the first transfer function.

Furthermore, the audio signal processing device 100 may obtain at least one flat response having a constant magnitude in a frequency domain. For example, the audio signal processing device 100 may receive at least one flat response from an external device. Alternatively, the audio signal processing device 100 may generate at least one flat response. Here, at least one flat response may include an ipsilateral flat response corresponding to an ipsilateral output channel and a contralateral flat response corresponding to a contralateral output channel. Alternatively, at least one flat response may include a plurality of flat responses corresponding to a single output channel. Here, the audio signal processing device 100 may divide a frequency domain to use different flat responses for each divided frequency domain.

For example, the audio signal processing device 100 may generate the flat response based on a binaural transfer function. Alternatively, according to an embodiment, the audio signal processing device 100 may generate the flat response based on a panning gain. The audio signal processing device 100 may use the panning gain as the flat response. The audio signal processing device 100 may generate the output audio signal based on the first transfer function pair and the panning gain. For example, the audio signal processing device 100 may determine the panning gain based on the position of the virtual sound source corresponding to the input audio signal with respect to the listener. Furthermore, the audio signal processing device 100 may generate the flat response having a constant magnitude in a frequency domain by using the panning gain. A method for determining the panning gain by the audio signal processing device 100 will be specifically described with reference to FIGS. 4 and 5.

According to an embodiment, the audio signal processing device 100 may generate a second transfer function pair for filtering the input audio signal based on the first transfer function pair and at least one flat response. The second transfer function pair may include the second transfer function. For example, the audio signal processing device 100 may generate the second transfer function by calculating a weighted sum of the first transfer function and at least one flat response. Here, the weighted sum may represent applying weight parameters to each of objects of the weighted sum and summing up the objects to which the weight parameter is applied, respectively.

In detail, the audio signal processing device 100 may generate the second transfer function by calculating, for each frequency bin, the weighted sum of the first transfer function and at least one flat response. For example, the audio signal processing device 100 may generate the second transfer function by calculating, for each frequency bin the weighted sum of magnitude components of the first transfer function and magnitude components of the flat response. Furthermore, the audio signal processing device 100 may generate the output audio signal by binaural rendering the input audio signal based on the generated second transfer function.

According to an embodiment, the audio signal processing device 100 may determine the degree by which the first transfer function is reflected to the second transfer function by using the weight parameter. The audio signal processing device 100 may generate the second transfer function by calculating the weighted sum of the first transfer function and the flat response based on the weight parameter.

For example, the weight parameter may include a first weight parameter applied to the first transfer function and a second weight parameter applied to the flat response. Here, the audio signal processing device 100 may generate the second transfer function by calculating the weighted sum of the first transfer function and the flat response based on the first weight parameter and the second weight parameter. In detail, the audio signal processing device 100 may generate the second transfer function by applying the first weight parameter "0.6" to the first transfer function and applying the second weight parameter "0.4" to the flat response. A method for determining the weight parameter by the audio signal processing device 100 will be specifically described with reference to FIG. 3. The audio signal processing device 100 may generate the output audio signal by binaural rendering the input audio signal based on the second transfer function generated through the weighted sum.

According to an embodiment, the audio signal processing device 100 may generate the second transfer function using different flat responses for each part of the frequency domain. For example, the audio signal processing device 100 may generate a plurality of flat responses including a first flat response and a second flat response. In this case, the audio signal processing device 100 may generate the second transfer function by calculating the weighted sum of the first transfer function and the first flat response in a first frequency band and the weighted sum of the first transfer function and the second flat response in a second frequency band.

According to an embodiment, the audio signal processing device 100 may generate the second transfer function having a phase component identical to a phase component of the first transfer function for each frequency. Here, the phase component may include a phase value of a transfer function for each frequency in a frequency domain. For example, the audio signal processing device 100 may generate the second transfer function by calculating the weighted sum of the first transfer function and the flat response with respect to magnitude components only. In this manner, the audio signal processing device 100 may generate the second transfer function pair maintaining an interaural phase difference (IPD) between the ipsilateral first transfer function and the contralateral first transfer function included in the first transfer function pair. Here, the interaural phase difference may be a characteristic corresponding to an interaural time difference (ITD) representing a time difference in which a sound is transferred to both ears of the listener, respectively, from the virtual sound source.

According to another embodiment, the audio signal processing device 100 may generate a plurality of intermediate audio signals by filtering the input audio signal with the first transfer function and at least one flat response. In this case, the audio signal processing device 100 may generate the output audio signal by synthesizing the plurality of intermediate audio signals for each channel. In detail, the audio signal processing device 100 may generate a first intermediate audio signal by binaural rendering the input audio signal based on the first transfer function. Furthermore, the audio signal processing device 100 may generate a second intermediate audio signal by filtering the input audio signal based on at least one flat response. Next, the audio signal processing device 100 may generate the output audio signal by mixing the first intermediate audio signal and the second intermediate audio signal.

Hereinafter, a method of generating the flat response based on a binaural transfer function by the audio signal processing device 100 according to an embodiment of the present disclosure is described.

According to an embodiment, the audio signal processing device 100 may generate at least one flat response based on at least a part of the first transfer function. Here, the audio signal processing device 100 may determine the flat response based on magnitude components of the first transfer function corresponding to at least some frequencies. Here, the magnitude components of the transfer function may represent magnitude components in a frequency domain. Furthermore, the magnitude components may include magnitudes obtained by taking the logarithm of magnitudes of the transfer function in a frequency domain and converting it into a decibel unit.

For example, the audio signal processing device 100 may use, as the flat response, a mean value of the magnitude components of the first transfer function. Here, the flat response may be expressed as Equation 1 and Equation 2. In Equation 1 and Equation 2, ave_H_l and ave_H_r may respectively denote left and right flat responses. In Equation 1 and Equation 2, abs(H_l(k)) may denote an absolute value of a left first transfer function for each frequency bin in a frequency domain, and abs(H_r(k)) may denote an absolute value of a right first transfer function for each frequency bin in a frequency domain. In Equation 1 and Equation 2, mean(x) may denote a mean of a function "x". Furthermore, in Equation 1 and Equation 2, k may denote a frequency bin number, and N may denote the number of points of fast Fourier transform (FFT). The audio signal processing device 100 may generate output audio signals respectively corresponding to each of left/right ears of the listener based on the left and right flat responses.

$$\text{ave_}H_l=\text{mean}(\text{abs}(H_l(k)))$$

$$\text{ave_}H_r=\text{mean}(\text{abs}(H_r(k))) \qquad \text{[Equation 1]}$$

where k is an integer such that 0<=k<=N/2.

$$\text{ave_}H_l=\text{mean}(20*\log 10(\text{abs}(H_l(k))))$$

$$\text{ave_}H_r=\text{mean}(20*\log 10(\text{abs}(H_r(k)))) \qquad \text{[Equation 2]}$$

where k is an integer such that 0<=k<=N/2.

In the embodiment of Equation 1 and Equation 2, k may be a frequency bin ranging from 0 to N/2, but the present disclosure is not limited thereto. For example, according to the embodiments described below, k may be a frequency bin of at least a part of the entire range of 0 to N/2.

Unlike Equation 1 and Equation 2, the audio signal processing device 100 may use the median value of the magnitude components of the first transfer function as the flat response. Also, the audio signal processing device 100 may use, as the flat response, the median or mean value of the magnitude components of the first transfer function corresponding to some frequency bins in a frequency domain. Here, the audio signal processing device 100 may determine a frequency bin which is used to determine the flat response.

For example, the audio signal processing device 100 may determine, based on the magnitude components of the first transfer function, the frequency bin which is used to determine the flat response. The audio signal processing device 100 may determine some frequency bins having magnitudes that fall within a predetermined range among the magnitude components of the first transfer function. Furthermore, the audio signal processing device 100 may determine the flat response based on the magnitude components of the first transfer function corresponding to some frequency bins respectively. Here, the predetermined range may be determined based on at least one of the maximum magnitude, minimum magnitude, or median value of the first transfer function. Alternatively, the audio signal processing device 100 may determine the frequency bin which is used to determine the flat response, based on information obtained with respect to the first transfer function.

Furthermore, the audio signal processing device 100 may generate the output audio signal based on the first transfer function pair and the flat response generated according to the above-mentioned embodiments.

Meanwhile, according to an embodiment, the audio signal processing device 100 may generate the ipsilateral and contralateral flat responses independently. The audio signal processing device 100 may generate the flat response based on each of the transfer functions included in the first transfer function pair. For example, the first transfer function pair may include the ipsilateral first transfer function and the contralateral first transfer function. The audio signal processing device 100 may generate the ipsilateral flat response based on magnitude components of the ipsilateral first transfer function. Furthermore, the audio signal processing device 100 may generate the contralateral flat response based on magnitude components of the contralateral first transfer function. Next, the audio signal processing device 100 may generate an ipsilateral second transfer function based on the ipsilateral first transfer function and the ipsilateral flat response. Furthermore, the audio signal processing device 100 may generate a contralateral second transfer function based on the contralateral first transfer function and the contralateral flat response. Next, the audio signal processing device 100 may generate the output audio signal based on the ipsilateral second transfer function and the contralateral second transfer function. In this manner, the audio signal processing device 100 may generate the second transfer function pair reflecting an interaural level difference (ILD) between the ipsilateral first transfer function and the contralateral first transfer function.

Figure 2:
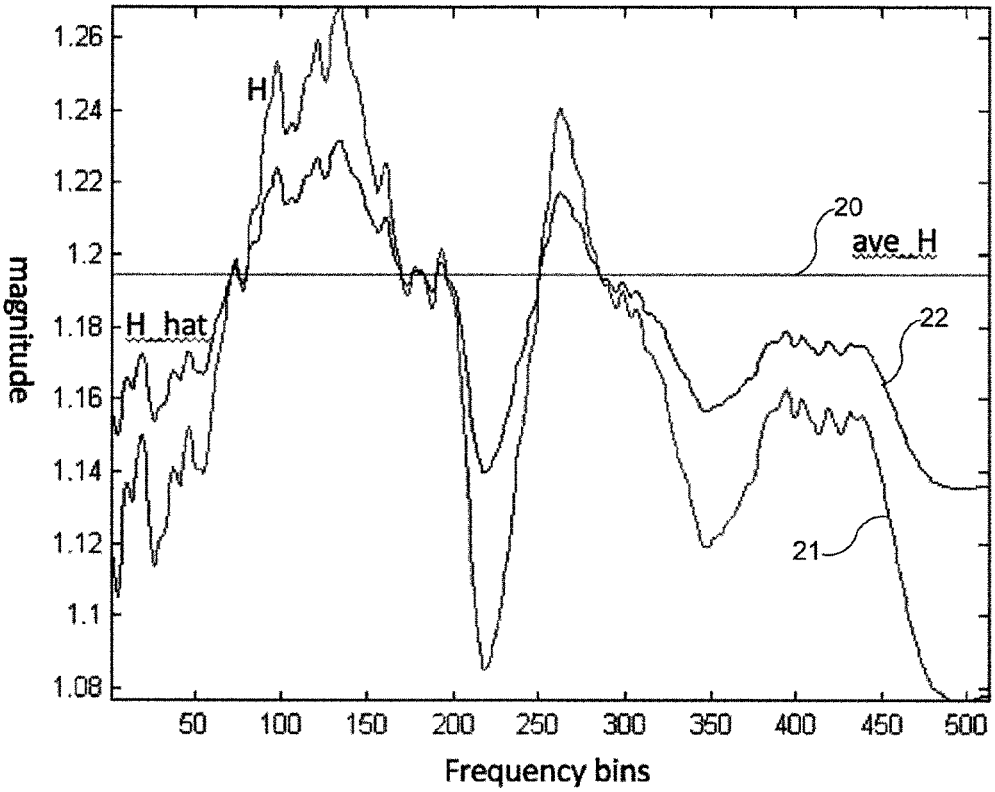
FIG. 2 illustrates frequency responses of a first transfer function, a second transfer function, and a flat response according to an embodiment of the present disclosure.

FIG. 2 illustrates frequency responses of a first transfer function 21, a second transfer function 22, and a flat response 20 according to an embodiment of the present disclosure.

In the embodiment of FIG. 2, the audio signal processing device 100 may generate the second transfer function 22 based on the first transfer function 21 and the flat response 20. FIG. 2 illustrates respective magnitude components of the flat response 20, the first transfer function 21 and the second transfer function 22. Here, the flat response 20 may be the mean value of the magnitude components of the first transfer function 21. As described above, the audio signal processing device 100 may generate the second transfer function 22 based on the first weight parameter applied to the first transfer function 21 and the second weight parameter applied to the flat response 20.

In FIG. 2, the second transfer function 22 represents a result of the weighted sum of the first transfer function to which the first weight parameter "0.5" is applied and the flat response 20 to which the second weight parameter "0.5" is applied. Referring to FIG. 2, the audio signal processing device 100 may provide the second transfer function 22 in which radical spectrum changes are mitigated in comparison with the first transfer function 21. Furthermore, the audio signal processing device 100 may generate a second output audio signal binaural rendered using the second transfer function 22. Here, the audio signal processing device 100 may provide the second output audio signal with a reduced timbre distortion in comparison with a first output audio signal binaural rendered using the first transfer function 21.

Furthermore, referring to FIG. 2, a shape of a frequency response of the second transfer function 22 is similar to a shape of a frequency response of the first transfer function 21. Accordingly, the audio signal processing device 100 may provide the second output audio signal with a reduced timbre distortion, while maintaining an elevation perception of a virtual sound source represented through the first transfer function 21.

Meanwhile, when the audio signal processing device 100 reduces the discrepancy between the timbres of the output and input audio signals by using the flat response, sound localization performance may be decreased. Here, the sound localization performance may represent the accuracy with which the position of a virtual sound source is represented in a three-dimensional space with respect to the listener. This is because when the weighted sum of the binaural transfer function and the flat response is used, the binaural cue of the binaural transfer function may be decreased. As described above, the binaural cue may include the notch component and the peak component of the binaural transfer function. As illustrated in FIG. 2, the audio signal processing device 100 may generate the second transfer function 22 with reduced notch component and peak component in comparison with the first transfer function 21. Here, as the value of the weight parameter applied to the flat response 20 becomes larger in comparison with the value of the weight parameter applied to the first transfer function 21, the binaural cue of the second transfer function 22 may be decreased.

According to an embodiment of the present disclosure, the audio signal processing device 100 may determine the weight parameter based on required sound localization performance or timbre preservation performance. Hereinafter, a method of generating the second transfer function pair using the weight parameter by the audio signal processing device 100 according to an embodiment of the present disclosure is described with reference to FIG. 3.

Figure 3:
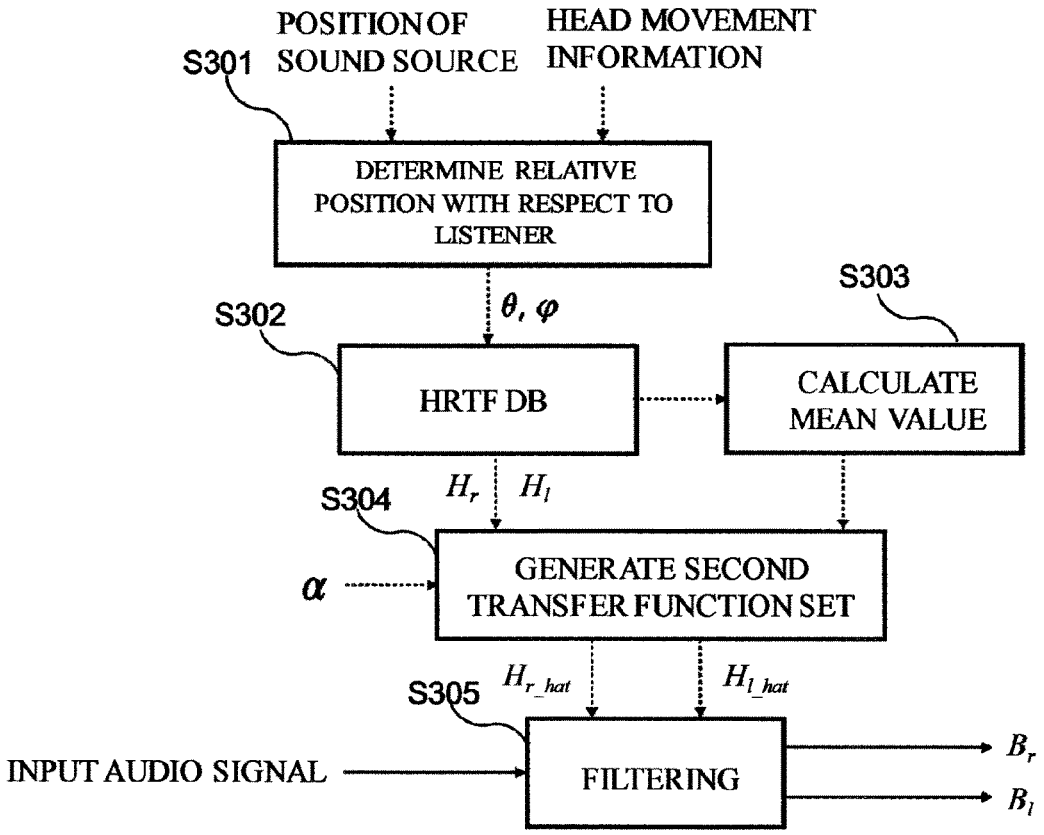
FIG. 3 is a block diagram illustrating a method by which an audio signal processing device according to an embodiment of the present disclosure generates a second transfer function pair based on a first transfer function pair.

FIG. 3 is a block diagram illustrating a method by which the audio signal processing device 100 according to an embodiment of the present disclosure generates the second transfer function pair based on the first transfer function pair.

Referring to FIG. 3, in step S301, the audio signal processing device 100 may determine the position of a virtual sound source corresponding to the input audio signal with respect to the listener. For example, the audio signal processing device 100 may determine a relative position (θ, φ) of the virtual sound source with respect to the listener based on position information of the virtual sound source corresponding to the input audio signal and head movement information of the listener. Here, the relative position (θ, φ) of the virtual sound source corresponding to the input audio signal may be expressed with elevation (θ) and azimuth (φ).

In step S302, the audio signal processing device 100 may obtain a first transfer function pair (Hr, Hl). The audio signal processing device 100 may obtain the first transfer function pair (Hr, Hl) based on the position of the virtual sound source corresponding to the input audio signal with respect to the listener. Here, the first transfer function pair (Hr, Hl) may include a right first transfer function Hr and a left first transfer function Hl. As described above, the audio signal processing device 100 may obtain the first transfer function pair (Hr, Hl) from a database (e.g. HRTF DB) including a plurality of transfer functions.

In step S303, the audio signal processing device 100 may generate a right flat response and a left flat response based on respective magnitude components of the right first transfer function Hr and the left first transfer function Hl. As illustrated in FIG. 3, the audio signal processing device 100 may generate the right flat response using the mean value of magnitude components of the right first transfer function Hr. Furthermore, the audio signal processing device 100 may generate the left flat response using the mean value of magnitude components of the left first transfer function Hl. The audio signal processing device 100 may generate the right and left flat responses independently. The audio signal processing device 100 may generate a second transfer function pair reflecting the interaural level difference (ILD) between the right first transfer function Hr and the left first transfer function Hl.

In step S304, the audio signal processing device 100 may generate a second transfer function pair (Hr_hat, Hl_hat) for filtering the input audio signal. The second transfer function pair (Hr_hat, Hl_hat) may include a right second transfer function Hr_hat and a left second transfer function Hl_hat. For example, the audio signal processing device 100 may generate the second transfer function by calculating the weighted sum of the first transfer function and at least one flat response. The audio signal processing device 100 may generate the right second transfer function Hr_hat by calculating the weighted sum of the right first transfer function Hr obtained in step S302 and the right flat response generated in step S303. Furthermore, the audio signal processing device 100 may generate the left second transfer function Hl_hat by calculating the weighted sum of the left first transfer function Hl and the left flat response.

According to an embodiment, the audio signal processing device 100 may determine the weight parameter based on binaural effect strength information. Here, the binaural effect strength information may be information indicating a ratio between the sound localization performance and the timbre preservation performance. For example, when the input audio signal includes an audio signal which requires high sound quality, a binaural rendering strength may be low. This is because the timbre preservation performance may be more important than the sound localization performance in the case of content including an audio signal which requires high sound quality. On the contrary, when the input audio signal includes an audio signal which requires high sound localization performance, the binaural rendering strength may be high.

According to an embodiment, the audio signal processing device 100 may obtain the binaural effect strength information corresponding to the input audio signal. For example, the audio signal processing device 100 may receive metadata corresponding to the input audio signal. Here, the metadata may include information indicating binaural effect strength. Alternatively, the audio signal processing device 100 may receive a user input indicating the binaural effect strength information corresponding to the input audio signal.

According to an embodiment, the audio signal processing device 100 may determine, based on the binaural effect strength information, the first weight parameter which is applied to the first transfer function and the second weight parameter which is applied to the flat response. Furthermore, the audio signal processing device 100 may generate the second transfer function by calculating the weighted sum of the first transfer function and the flat response based on the first weight parameter and the second weight parameter.

According to an embodiment, the binaural effect strength information may indicate non-application of binaural rendering. Here, the audio signal processing device 100 may determine the first weight parameter which is applied to the first transfer function as "0" based on the binaural effect strength information. Furthermore, the audio signal processing device 100 may generate the output audio signal by rendering the input audio signal based on the second transfer function identical to the flat response.

Furthermore, the binaural effect strength information may indicate an application degree of binaural rendering. In detail, the binaural effect strength may be classified into quantized levels. The binaural effect strength information may be classified into levels from 1 to 10. Here, the audio signal processing device 100 may determine the weight parameter based on the binaural effect strength information.

In a specific embodiment, the audio signal processing device 100 may receive metadata which indicates "8" as the binaural effect strength corresponding to the input audio signal. Furthermore, the audio signal processing device 100 may receive information indicating that the binaural effect strength is classified into levels form 1 to 10. Here, the audio signal processing device 100 may determine the first weight parameter which is applied to the first transfer function as "0.8". Furthermore, the audio signal processing device 100 may determine the second weight parameter which is applied to the flat response as "0.2". Here, the sum of the first and second weight parameters may be a preset value. For example, the sum of the first and second weight parameters may be "1". The audio signal processing device 100 may generate the second transfer function based on the determined first and second weight parameters.

Referring to FIG. 3, "α" (alpha) in step S304 represents an example of the weight parameter which is used to calculate the weighted sum of the flat response and the binaural transfer function. The audio signal processing device 100 may determine "α" as a value between 0 and 1. Here, the audio signal processing device 100 may generate the second transfer function based on "α". The second transfer function pair (H_l_hat, H_r_hat) may be expressed as Equation 3. In Equation 3, ave_H_l and ave_H_r may respectively denote left and right flat responses. In Equation 3, abs(H_l(k)) may denote an absolute value of a left first transfer function for each frequency bin in a frequency domain, and abs(H_r(k)) may denote an absolute value of a right first transfer function for each frequency bin in a frequency domain. In Equation 3, phase(H_l(k)) may denote a phase value of a left first transfer function for each frequency bin in a frequency domain, and phase(H_r(k)) may denote a phase value of a right first transfer function for each frequency bin in a frequency domain. Furthermore, in Equation 3, k may denote a frequency bin number.

$$H_r_\mathrm{hat}(k)=(\alpha*\mathrm{ave}_H_r+(1-\alpha)\mathrm{abs}(H_r(k)))*\mathrm{phase}(H_r(k))$$

$$H_l_\mathrm{hat}(k)=(\alpha*\mathrm{ave}_H_l+(1-\alpha)\mathrm{abs}(H_l(k)))*\mathrm{phase}(H_l(k)) \quad \text{[Equation 3]}$$

where k is an integer such that 0<=k<=N/2.

In Equation 3, as described above, respective phase components of the right second transfer function H_r_hat and the left second transfer function H_l_hat may be respectively identical to the phase component phase(H_r) of the right first transfer function H_r and the phase component phase(H_r) of the left first transfer function H_l.

According to an embodiment, the audio signal processing device 100 may determine the weight parameter "α" based on the binaural effect strength information corresponding to the input audio signal. For example, in Equation 3, the audio signal processing device 100 may determine "α" as a smaller value as the binaural effect strength corresponding to the input audio signal becomes higher.

According to an embodiment, when "α" is close to 0, the audio signal processing device 100 may generate the output audio signal having relatively excellent sound localization performance compared to the timbre preservation performance. When "α" is 0, the second transfer function may be identical to the first transfer function.

According to another embodiment, when "α" is close to 1, the audio signal processing device 100 may generate the output audio signal having relatively excellent timbre preservation performance compared to the sound localization performance. When "α" which is set to 0, it may indicate non-application of binaural rendering.

In step S305, the audio signal processing device 100 may generate output audio signals (Br, Bl) by filtering the input audio signal based on the second transfer function pair (Hr_hat, Hl_hat).

According to an embodiment of the present disclosure, the audio signal processing device 100 may provide a plurality of binaural transfer functions according to the binaural effect strength by using the weight parameter. For example, the audio signal processing device 100 may generate a plurality of second transfer function pairs based on the first transfer function pair and the flat response. The plurality of second transfer function pairs may include a transfer function pair corresponding to first application strength and a transfer function pair corresponding to second application strength. Here, the first application strength and the second application strength may represent weight parameters, which are different from each other, applied to the first transfer function pair when generating the transfer function pair.

Although the audio signal processing device 100 is described as generating the second transfer function based on the weight parameter in an embodiment of FIG. 3, the audio signal processing device 100 may directly generate the output audio signal based on the weight parameter according to another embodiment of the present disclosure.

For example, the audio signal processing device 100 may generate the first intermediate audio signal by binaural rendering the input audio signal based on the first transfer function obtained in step S302. Furthermore, the audio signal processing device 100 may generate the second intermediate audio signal by filtering the input audio signal based on the flat response generated in step S303. Thereafter, the audio signal processing device 100 may generate the output audio signal by mixing the first intermediate audio signal and the second intermediate audio signal based on the weight parameter "α" of step S304. Here, the weight parameter may be used as a mixing gain indicating a ratio between the first intermediate signal and the second intermediate signal reflected in the output audio signal.

In a specific embodiment, the audio signal processing device 100 may determine, based on the binaural effect strength information corresponding to the input signal, a first mixing gain which is applied to the first transfer function and a second mixing gain which is applied to the at least one flat response. Here, the audio signal processing device 100 may determine the first mixing gain and the second mixing gain in a same or corresponding manner to the method of determining the first weight parameter and the second weight parameter described in step S304.

Meanwhile, when the audio signal processing device 100 generates the second transfer function pair based on the first transfer function pair and the flat response, an energy level of a second transfer function included in the second transfer function pair may be varied. For example, the energy level may be more significantly modified when the difference between the energy level of the flat response and the energy level of the first transfer function included in the first transfer function pair becomes larger. In this case, due to the energy level variation of the second transfer function, the energy level of the output audio signal may be excessively modified in comparison with the energy level of the input audio signal. For example, the output audio signal may be listened to the listener with an excessively large or small energy level in comparison with the input audio signal.

Hereinafter, a method of generating an energy-compensated second transfer function pair by the audio signal processing device 100 according to an embodiment of the present disclosure is described.

According to an embodiment, the audio signal processing device 100 may configure such that the sum of energies of the transfer functions included in the second transfer function pair is equal to the sum of energies of the transfer functions included in the first transfer function pair. In detail, the audio signal processing device 100 may determine, as a gain "β" (beta) for energy compensation, a ratio between the sum of the energies of the transfer functions included in the second transfer function pair and the sum of the energies of the transfer functions included in the first transfer function pair. Here, "β" may be expressed as Equation 4. In Equation 4, abs(x) may denote an absolute value of a transfer function "x" for each frequency bin in a frequency domain. In Equation 4, mean(x) may denote a mean of the function "x". Furthermore, in Equation 4, k may denote a frequency bin number, and N may denote the number of points of FFT.

$$\beta=(\text{mean}(\text{abs}(H_l(k)))+\text{mean}(\text{abs}(H_r(k))))/(\text{mean}(\text{abs}(H_l_\text{hat}(k)))+\text{mean}(\text{abs}(H_r_\text{hat}(k))))$$

or $$\beta=(\text{mean}(20*\log 10(\text{abs}(H_l(k))))+\text{mean}(20*\log 10(\text{abs}(H_r(k)))))/(\text{mean}(20*\log 10(\text{abs}(H_l_\text{hat}(k))))+\text{mean}(20*\log \mathbf{10}(\text{abs}(H_r_\text{hat}(k)))))$$ [Equation 4]

where k is an integer such that 0<=k<=N/2.

Furthermore, referring to Equation 5, the audio signal processing device 100 may obtain a right second transfer function H_r_hat2 and a left second transfer function H_l_hat2 which have been energy-compensated based on the right second transfer function H_r_hat and the left second transfer function H_l_hat obtained in Equation 3, and the gain "β" for energy compensation. In Equation 5, k may denote a frequency bin number.

$$H_r_\text{hat2}(k)=\beta*H_r_\text{hat}(k)$$

$$H_l_\text{hat2}(k)=\beta*H_l_\text{hat}(k)$$ [Equation 5]

where k is an integer such that 0<=k<=N/2.

Meanwhile, as described above, the flat response described with reference to FIGS. 1 to 3 may be generated using the panning gain. Hereinafter, a method of determining the panning gain by which the audio signal processing device 100 according to an embodiment of the present disclosure is described with reference to FIGS. 4 and 5.

Figure 4:
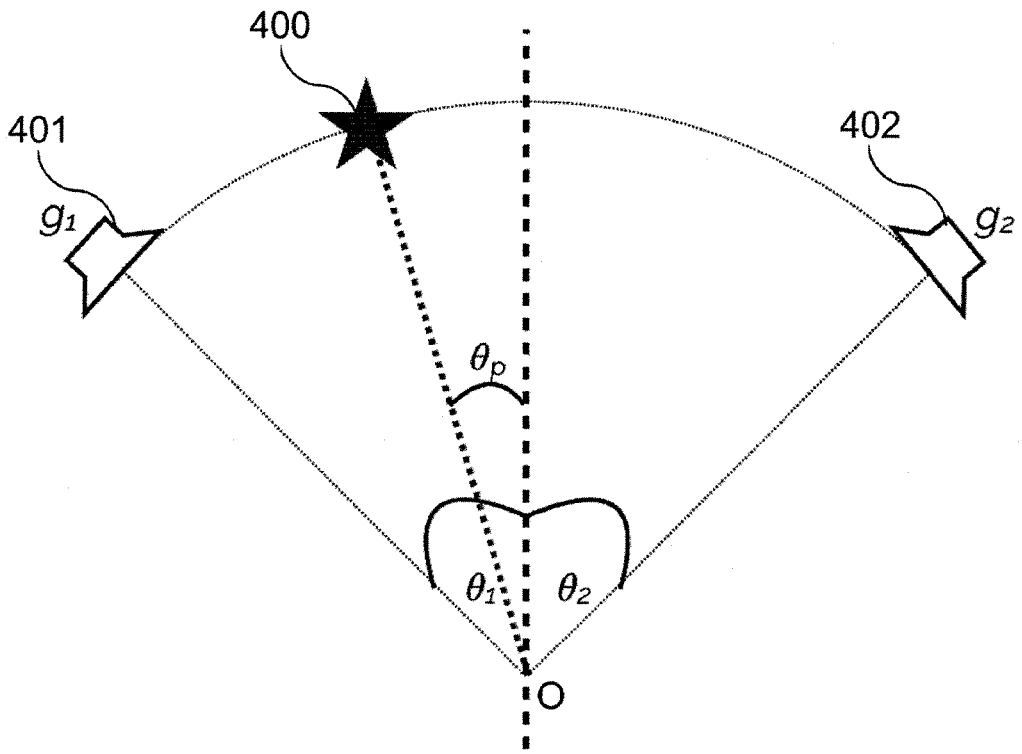
FIG. 4 is a diagram illustrating a method of determining a panning gain by an audio signal processing device in a loud speaker environment.

FIG. 4 is a diagram illustrating a method of determining the panning gain by the audio signal processing device 100 in a loud speaker environment.

Referring to FIG. 4, the audio signal processing device 100 may localize a virtual sound source between two loud speakers 401 and 402 using positions where the two loud speakers 401 and 402 are arranged. Here, the audio signal processing device 100 may localize the virtual sound source using the panning gain.

As illustrated in FIG. 4, the audio signal processing device 100 may localize a virtual sound source 400 between the two loud speakers 401 and 402 using an angle formed between the positions of the two loud speakers 401 and 402 with respect to the position of the listener (e.g., "○" of FIG. 4). For example, the audio signal processing device 100 may obtain the panning gain for localizing the virtual sound source 400 corresponding to the input audio signal, based on the angle between the two loud speakers 401 and 402. The audio signal processing device 100 may provide, to the listener, a sound effect in which an audio signal is output from the virtual sound source, through the output audio signals output from the two loud speakers based on the panning gain.

Referring to FIG. 4, the audio signal processing device 100 may localize the virtual sound source 400 at a position corresponding to an angle $\theta p$ with respect to a central symmetry axis between the first loud speaker 401 and the second loud speaker 402. Here, the audio signal processing device 100 may provide the listener with an audio signal representing that a sound is delivered from the virtual sound source 400 localized at the angle θp, through outputs from the first loud speaker 401 and the second loud speaker 402.

In detail, the audio signal processing device 100 may determine panning gains g1 and g2 for localizing the virtual sound source 400 at the position of Op. Here, the panning gains g1 and g2 may be respectively applied to the first loud speaker 401 and the second loud speaker 402. The audio signal processing device 100 may determine the panning gains g1 and g2 using a typical panning gain obtaining method. For example, the audio signal processing device 100 may determine the panning gains g1 and g2 using a linear panning method or a constant power panning method.

According to an embodiment of the present disclosure, the audio signal processing device 100 may apply, to a headphone environment, the panning gain used in the loud speaker environment. For example, a left output channel and a right output channel of a headphone of the listener may be respectively matched to the first loud speaker 401 and the second loud speaker 402. Here, the first loud speaker 401 and the second loud speaker 402, which respectively correspond to the left output channel and the right output channel of the headphone, may be assumed to be positioned at positions corresponding to left and right 90 degrees (i.e., −90 degrees and +90 degrees) with respect to the symmetry axis. For example, a first output channel (e.g., the left output channel of a headphone) may be located at left 90 degrees with respect to the symmetry axis, and a second output channel (e.g., the right output channel of a headphone) may be located at right 90 degrees with respect to the symmetry axis.

According to an embodiment, the audio signal processing device 100 may determine the first panning gain g1 and the second panning gain g2 based on the position of the virtual sound source 400 corresponding to the input audio signal with respect to the listener. Here, the audio signal processing device 100 may obtain the first transfer function pair and the panning gain based on the same position information. The first panning gain g1, the second panning gain g2, and each transfer function included in the first transfer function pair may be respective filter coefficient sets obtained based on the same position information. Here, the filter coefficient set may include at least one filter coefficient representing a filter characteristic. For example, the audio signal processing device 100 may obtain a plurality of filter coefficient sets having different characteristics based on the same position information. Meanwhile, the first panning gain g1 and the second panning gain g2 may be panning gains for localizing the virtual sound source 400 at the position of Op between the first output channel and the second output channel.

According to an embodiment, the audio signal processing device 100 may generate the output audio signal based on the first transfer function pair and the panning gain. Here, to generate the output audio signal based on the first transfer function pair and the panning gain, the above-mentioned embodiments for generating the output audio signal based on the first transfer function pair and at least one flat response may be applied.

For example, the audio signal processing device 100 may generate at least one flat response based on the panning gain. For example, the audio signal processing device 100 may generate a left flat response based on the first panning gain g1. Furthermore, the audio signal processing device 100 may generate a right flat response based on the second panning gain g1.

Alternatively, the audio signal processing device 100 may generate the second transfer function based on the first transfer function and the panning gain. The audio signal processing device 100 may generate a left second transfer function based on the generated left flat response and left first transfer function. The audio signal processing device 100 may generate a right second transfer function based on the generated right flat response and right first transfer function. The audio signal processing device 100 may generate the output audio signal by binaural rendering the input audio signal based on the generated left second transfer function and right second transfer function.

Alternatively, the panning gain may be used as the flat response to be mixed with a first intermediate audio signal to generate the output audio signal. The first immediate audio signal is generated by filtering the input audio signal based on the first transfer function. The audio signal processing device 100 may generate a second intermediate audio signal by filtering the input audio signal with the flat response generated based on the panning gain. Furthermore, the audio signal processing device 100 may generate the output audio signal by mixing the first intermediate audio signal and the second intermediate audio signal.

According to an embodiment, the audio signal processing device 100 may determine the first panning gain g1 and the second panning gain g2 using the constant power panning method. The constant power panning method may represent a method in which the sum of powers of the first output channel and the second output channel to which the panning gains are applied is constant. The panning gains g1 and g2 determined using the constant power panning method may be expressed as Equation 6.

$$g1=\cos(p)$$

$$g2=\sin(p) \quad \text{[Equation 6]}$$

where, $$P=90*(\theta p-\theta 1)/(\theta 2-\theta 1)$$

For example, when θ1 and θ2 are respectively −90 degrees and 90 degrees, an arbitrary angle θ*p* between θ1 and θ2 may have a value between −90 degrees and 90 degrees. Here, when θp ranges from −90 degrees to 90 degrees, p has a value between 0 degree and 90 degrees according to Equation 6. p may be a value converted from θp to calculate first panning gain g1 and second panning gain g2 of positive values corresponding to the virtual sound source located at θp between θ1 and θ2.

In the embodiment of Equation 6, the audio signal processing device 100 uses the constant power panning method to determine the panning gains respectively applied to the first output channel and the second output channel, but the method for determining the panning gains by the audio signal processing device 100 is not limited thereto.

Meanwhile, according to an embodiment of the present disclosure, the audio signal processing device 100 may determine the panning gain using an interaural polar coordinate (IPC) system. For example, the audio signal processing device 100 may determine the panning gain based on interaural polar coordinates indicating the position of the virtual sound source in the interaural polar coordinate system. Furthermore, the audio signal processing device 100 may generate the output audio signal through the method described above with reference to FIGS. 1 to 3, using the panning gain determined based on the interaural polar coordinates. Hereinafter, a method of determining the panning gain using the interaural polar coordinate system by the audio signal processing device 100 according to an embodiment of the present disclosure is described with reference to FIG. 5.

Figure 5:
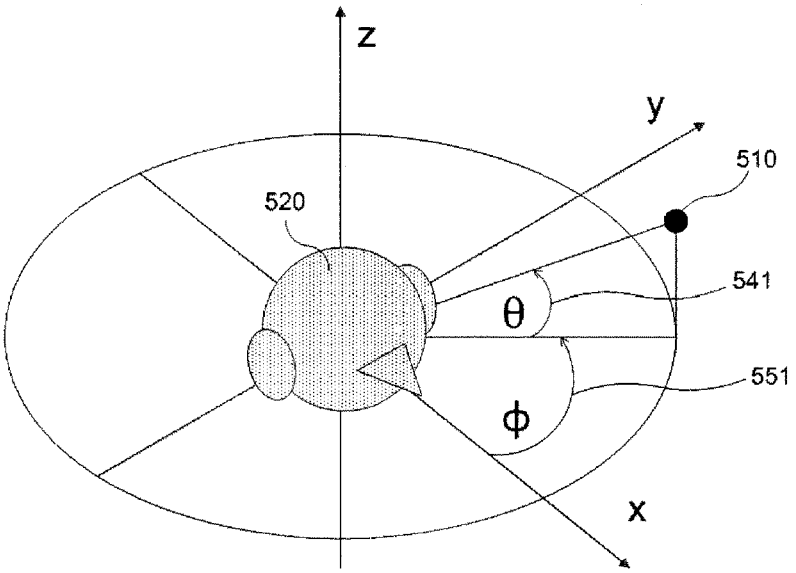
FIG. 5 is a diagram illustrating a vertical polar coordinate system and an interaural polar coordinate system.
Figure 5:
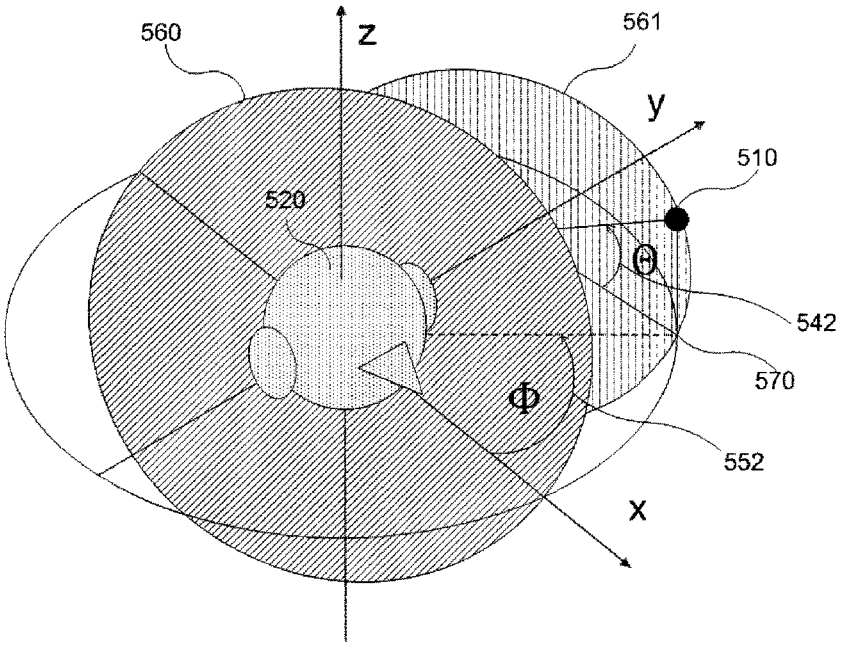

FIG. 5 is a diagram illustrating a vertical polar coordinate (VPC) system and an interaural polar coordinate (IPC) system. Referring to FIG. 5, an object 510 corresponding to the input audio signal may be expressed by a first azimuth 551 and a first elevation 541 in the vertical polar coordinate system 501. Furthermore, the object 510 corresponding to the input audio signal may be expressed by a second azimuth 552 and a second elevation 542 in the interaural polar coordinate system 502.

According to an embodiment, the object 510 corresponding to the input audio signal may move to a top of a head (i.e. z axis) of a listener 520, while maintaining the azimuth 501 of the vertical polar coordinate system 501. When the object moves in this manner, the first elevation 541 may change from θ to 90 degrees, and the first azimuth 551 may be maintained as D. The first elevation 541 and the first azimuth 551 indicates the position of the object 510 corresponding to the input audio signal in the vertical polar coordinate system. On the contrary, the second azimuth 552 which indicates the position of the object 510 in the interaural polar coordinate system 502 may vary with the above-mentioned movement of the object 510. For example, when the first elevation 541 which indicates the position of the object corresponding to the input audio signal in the vertical polar coordinate system changes from θ to 90 degrees, the second azimuth 552 which indicates the position of the object corresponding to the input signal in the interaural polar coordinate system may change from ϕ to 0 degree. Here, the second elevation 542 which indicates the position of the object corresponding to the input audio signal in the interaural polar coordinate system may be equal to the first elevation 541.

Accordingly, when the panning gain is determined using the first azimuth 551 of the vertical polar coordinate system in a situation in which the object 510 is moving as described above, the listener 520 is unable to sense a movement of a sound source since the panning gain does not change. On the contrary, when the panning gain is determined using the second azimuth 552 in the interaural polar coordinate system where the object 510 is moving as described above, the listener 520 may sense the movement of the sound source due to a change of the panning gain. Here, the panning gain may be determined by reflecting horizontal movement on a horizontal plane due to a change of the second azimuth 552. This is because when the object 520 moves to the top of the head of the listener 520, the second azimuth 552 in the interaural polar coordinate system approximates to "0".

According to an embodiment, the audio signal processing device 100 may determine the panning gain using the interaural polar coordinate system. For example, the audio signal processing device 100 may obtain a value ϕ of the second azimuth 552 and a value θ of the second elevation 542 indicating the position of the virtual sound source corresponding to the input audio signal in the interaural polar coordinate system. In detail, the audio signal processing device 100 may receive metadata including the value ϕ of the second azimuth 552. Here, the metadata may be metadata corresponding to the input audio signal. Furthermore, the audio signal processing device 100 may determine a first panning gain g1' and a second panning gain g2' based on the obtained value ϕ of the second azimuth 552. The first panning gain g1' and the second panning gain g2' may be expressed as Equation 7.

$$g1'=\cos(0.5*\phi+45)$$

$$g2'=\sin(0.5*\phi+45) \quad \text{[Equation 7]}$$

According to an embodiment, the audio signal processing device 100 may receive the head movement information of the listener and the position information of the virtual sound source corresponding to the input audio signal as described in the embodiment of FIG. 3. In this case, the audio signal processing device 100 may calculate the vertical polar coordinates (551, 541) or the interaural polar coordinates (552, 542) indicating the relative position of the virtual sound source with respect to the listener, based on the position information of the virtual sound source and the head movement information of the listener.

In detail, referring to FIG. 5, the audio signal processing device 100 may determine a sagittal plane (or constant azimuth plane) 561 in the interaural polar coordinate system 502 based on the position of the object 510. Here, the sagittal plane 561 may be parallel with a median plane 560. Furthermore, the median plane 561 may be a plane which is vertical to the horizontal plane and has the same center as the horizontal plane. The second azimuth 552 may be determined as an angle between a point 570 and the median plane 560 based on the center of the median plane 560, by the audio signal processing device 100. The point 570 indicates a point at which the sagittal plane 561 meets the horizontal plane. In this manner, the second azimuth 552 in the interaural polar coordinate system may reflect a change of the value of the first elevation 541 of the objects 510, which moves as described above, in the vertical polar coordinate system.

Furthermore, according to an embodiment, the audio signal processing device 100 may obtain coordinates indicating the position of the virtual sound source corresponding to the input audio signal in a coordinate system other than the interaural polar coordinate system. In this case, the audio signal processing device 100 may convert the obtained coordinates into interaural polar coordinates. Here, the coordinate system other than the interaural polar coordinate system may include a vertical polar coordinate system and an orthogonal coordinate system. For example, referring to FIG. 5, the audio signal processing device 100 may obtain vertical polar coordinates (551, 541) indicating the position of the virtual sound source corresponding to the input audio signal in the vertical polar coordinate system 501. In this case, the audio signal processing device 100 may convert the value of the first azimuth 551 and the value of the first elevation 541 of the vertical polar coordinates into the value of the second azimuth 552 and the value of the second elevation 542 of the interaural polar coordinates.

Furthermore, the audio signal processing device 100 may determine the panning gains g1' and g2' based on the determined value of the second azimuth 552. For example, the audio signal processing device 100 may determine the panning gains g1' and g2' based on the value of the second azimuth 552 using the constant power panning method or linear panning method.

Furthermore, the audio signal processing device 100 may generate the output audio signal by binaural rendering the input audio signal based on the first transfer function pair and the panning gains g1' and g2' determined using the above-mentioned method. According to an embodiment, the audio signal processing device 100 may generate the output audio signal in a same or corresponding manner to the method described with reference to FIGS. 1 and 4, using the first transfer function pair and the panning gains g1' and g2' determined using the above-mentioned method.

For example, the audio signal processing device 100 may generate a second transfer function pair based on the first transfer function pair and the panning gains g1' and g2'. The audio signal processing device 100 may generate at least one flat response based on the panning gains g1' and g2'. Furthermore, the audio signal processing device 100 may generate the second transfer function by calculating the weighted sum of the first transfer function and the flat response generated based on any one of the panning gains g1' and g2'. Here, the audio signal processing device 100 may use the weight parameter determined based on the binaural effect strength information. Furthermore, the audio signal processing device 100 may generate the output audio signal based on the second transfer function pair.

Alternatively, the audio signal processing device 100 may generate a plurality of intermediate audio signals by filtering the input audio signal based on the first transfer function pair and the panning gains g1' and g2'. In this case, the audio signal processing device 100 may generate the output audio signal by synthesizing the plurality of intermediate audio signals for each channel.

Hereinafter, a method of rendering an input audio signal using a panning gain by an audio signal processing device 100 according to another embodiment of the present disclosure is described with reference to FIG. 6.

Figure 6:
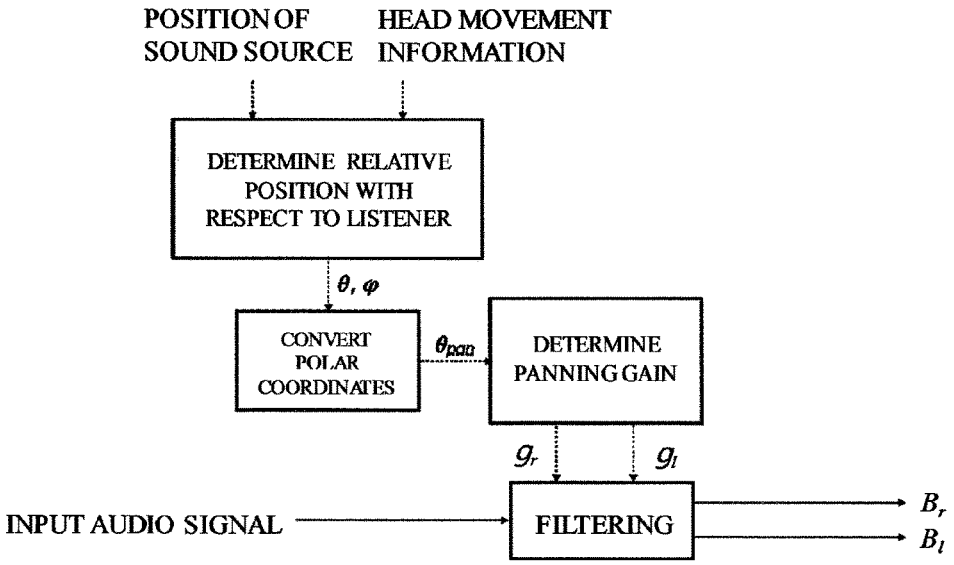
FIG. 6 illustrates a method by which an audio signal processing device generates an output audio signal using an interaural polar coordinate system according to another embodiment of the present disclosure.

FIG. 6 illustrates a method by which an audio signal processing device generates an output audio signal using an interaural polar coordinate system according to another embodiment of the present disclosure. For example, when the audio signal processing device 100 does not use an HRTF, the audio signal processing device 100 may perform interactive rendering by using the panning gain described with reference to FIG. 5.

According to an embodiment, the audio signal processing device 100 may generate the output audio signal based on a value of an azimuth θpan in the interaural polar coordinate system. For example, the audio signal processing device 100 may generate output audio signals B_l, B_r by filtering the input audio signal based on the first panning gain g1' and the second panning gain g2' generated through Equation 7. According to an embodiment, the audio signal processing device 100 may obtain the position of a virtual sound source expressed by coordinates other than interaural polar coordinates. In this case, the audio signal processing device 100 may convert the coordinates other than the interaural polar coordinates into the interaural polar coordinates. For example, as illustrated in FIG. 6, the audio signal processing device 100 may convert vertical polar coordinates (θ, φ) into interaural polar coordinates.

Figure 7:
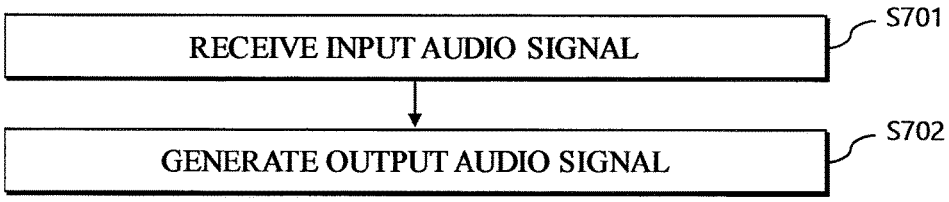
FIG. 7 is a flowchart illustrating a method for operating an audio signal processing device according to an embodiment of the present disclosure.

FIG. 7 is a flowchart illustrating a method for operating the audio signal processing device 100 according to an embodiment of the present disclosure.

In step S701, the audio signal processing device 100 may receive an input audio signal. In step S702, the audio signal processing device 100 may generate an output audio signal by binaural rendering the input audio signal based on a first transfer function pair and at least one flat response. Furthermore, the audio signal processing device 100 may output the generated output audio signal.

For example, the audio signal processing device 100 may generate a second transfer function based on the first transfer function and at least one flat response. The audio signal processing device 100 may obtain the first transfer function based on the position of a virtual sound source corresponding to the input audio signal with respect to a listener. The audio signal processing device 100 may generate at least one flat response having a constant magnitude in a frequency domain. In detail, the audio signal processing device 100 may generate the second transfer function by calculating the weighted sum of the first transfer function and at least one flat response. Here, the audio signal processing device 100 may determine, based on binaural effect strength information corresponding to the input audio signal, a weight parameter which is used for the weighted sum of the first transfer function and at least one flat response. The audio signal processing device 100 may generate the second transfer function based on the determined weight parameter. Furthermore, the audio signal processing device 100 may generate the output audio signal based on the second transfer function generated as described above.

According to an embodiment, the audio signal processing device 100 may generate the second transfer function by calculating, for each frequency bin, the weighted sum of magnitude components of the first transfer function and the at least one flat response. Here, phase components of the second transfer function may be identical to the phase components of the first transfer function, corresponding to respective frequency bins in a frequency domain.

According to an embodiment, the audio signal processing device 100 may generate the flat response based on at least a part of the first transfer function. For example, the at least one flat response may be the mean value of the magnitude components of the first transfer function corresponding to at least some frequency bins. Alternatively, the at least one flat response may be the median value of the magnitude components of the first transfer function corresponding to at least some frequency bins.

According to an embodiment, the audio signal processing device 100 may generate the output audio signal based on the first transfer function and a panning gain. For example, the audio signal processing device 100 may generate a plurality of intermediate audio signals by filtering the input audio signal based on each of the first transfer function and the panning gain. Furthermore, the audio signal processing device 100 may generate the output audio signal by mixing the plurality of intermediate audio signals for each channel. Alternatively, the audio signal processing device 100 may generate at least one flat response based on the panning gain. Furthermore, the audio signal processing device 100 may generate the second transfer function based on the generated flat response and the first transfer function.

In this case, the audio signal processing device 100 may determine the panning gain based on the position of the virtual sound source corresponding to the input audio signal with respect to the listener. In detail, the audio signal processing device 100 may determine the panning gain using the constant power panning method. Furthermore, the audio signal processing device 100 may determine the panning gain using interaural polar coordinates. The audio signal processing device 100 may determine the panning gain based on an azimuth value of the interaural polar coordinates. According to an embodiment, the audio signal processing device 100 may convert vertical polar coordinates indicating the position of the virtual sound source corresponding to the input audio signal into the interaural polar coordinates. Furthermore, the audio signal processing device 100 may determine the panning gain based on an azimuth value of the converted interaural polar coordinates. Here, the azimuth value in the interaural polar coordinate system may reflect a change of an elevation in the vertical polar coordinate system due to movement of the object.

Although the present invention has been described using the specific embodiments, those skilled in the art could make changes and modifications without departing from the spirit and the scope of the present invention. That is, although the embodiments of binaural rendering for audio signals have been described, the present invention can be equally applied and extended to various multimedia signals including not only audio signals but also video signals. Therefore, any derivatives that could be easily inferred by those skilled in the art from the detailed description and the embodiments of the present invention should be construed as falling within the scope of right of the present invention.

What is claimed is:

1. An audio signal processing device for rendering an input audio signal, the audio signal processing device comprising:

a receiving unit configured to receive the input audio signal;

a processor configured to generate an output audio signal by binaural rendering the input audio signal; and an output unit configured to output the output audio signal generated by the processor, wherein the processor is configured to:

obtain a first transfer function based on a position of a virtual sound source corresponding to the input audio signal with respect to a listener;

generate at least one flat response having a constant magnitude in a frequency domain;

generate a second transfer function based on the first transfer function and the at least one flat response; and generate the output audio signal by binaural rendering the input audio signal based on the generated second transfer function.

2. The audio signal processing device of claim 1, wherein the processor is configured to generate the second transfer function by calculating a weighted sum of the first transfer function and the at least one flat response.

3. The audio signal processing device of claim 2, wherein the processor is configured to:

determine a weight parameter which is used for the weighted sum of the first transfer function and the at least one flat response, based on binaural effect strength information corresponding to the input audio signal; and generate the second transfer function based on the determined weight parameter.

4. The audio signal processing device of claim 3, wherein the first transfer function comprises magnitude components in the frequency domain, and wherein the processor is configured to generate the second transfer function by calculating, for each frequency bin, a weighted sum of the magnitude components and the at least one flat response based on the weight parameter.

5. The audio signal processing device of claim 1, wherein phase components of the second transfer function are identical to phase components of the first transfer function, corresponding to the respective frequency bins in the frequency domain.

6. The audio signal processing device of claim 1, wherein the processor is configured to:

determine a panning gain based on the position of the virtual sound source corresponding to the input audio signal with respect to the listener; and generate the at least one flat response based on the panning gain.

7. The audio signal processing device of claim 6, wherein the processor is configured to determine the panning gain based on an azimuth value of an interaural polar coordinates indicating the position of the virtual sound source.

8. The audio signal processing device of claim 1, wherein the processor is configured to generate the at least one flat response based on at least a part of the first transfer function.

9. The audio signal processing device of claim 8, wherein the at least one flat response is a mean of magnitude components of the first transfer function corresponding to at least some frequencies.

10. The audio signal processing device of claim 1, wherein the first transfer function is either an ipsilateral head related transfer function (HRTF) or a contralateral HRTF included in an HRTF pair corresponding to the position of the virtual sound source corresponding to the input audio signal.

11. The audio signal processing device of claim 10, wherein the processor is configured to:

generate each of an ipsilateral second transfer function and a contralateral second transfer function based on each of the ipsilateral HRTF and the contralateral HRTF, and the at least one flat response; and set a sum of energy levels of the ipsilateral second transfer function and the contralateral second transfer function to be equal to a sum of energy levels of the ipsilateral HRTF and the contralateral HRTF.

12. An audio signal processing method comprising the steps of:

receiving an input audio signal;

obtaining a first transfer function based on a position of a virtual sound source corresponding to the input audio signal with respect to a listener;

generating at least one flat response having a constant magnitude in a frequency domain;

generating a second transfer function based on the first transfer function and the at least one flat response;

generating an output audio signal by binaural rendering the input audio signal based on the generated second transfer function; and outputting the generated output audio signal.

13. The audio signal processing method of claim 12, wherein generating the second transfer function comprises generating the second transfer function by calculating a weighted sum of the first transfer function and the at least one flat response.

14. The audio signal processing method of claim 13, wherein generating the second transfer function comprises:

determining a weight parameter which is used for the weighted sum of the first transfer function and the at least one flat response, based on binaural effect strength information corresponding to the input audio signal; and generating the second transfer function based on the determined weight parameter.

15. The audio signal processing method of claim 14, wherein the first transfer function comprises magnitude components in the frequency domain, and wherein generating the second transfer function, the second transfer function is generated by calculating, for each frequency bin, a weighted sum of the magnitude components and the at least one flat response based on the weight parameter.

16. The audio signal processing method of claim 12, wherein phase components of the second transfer function are identical to phase components of the first transfer function, corresponding to the respective frequency bins in the frequency domain.

17. The audio signal processing method of claim 12, wherein generating the flat response comprises:

determining a panning gain based on the position of the virtual sound source corresponding to the input audio signal with respect to the listener; and generating the at least one flat response based on the panning gain.

18. The audio signal processing method of claim 17, wherein determining the panning gain comprises determining the panning gain based on an azimuth value of an interaural polar coordinates indicating the position of the virtual sound source.

19. The audio signal processing method of claim 12, wherein generating the flat response comprises generating the at least one flat response based on at least a part of the first transfer function.

20. The audio signal processing method of claim 19, wherein the at least one flat response is a mean of magnitude components of the first transfer function corresponding to at least some frequencies.

* * * * *